US006669876B2

(12) United States Patent
Torrance

(10) Patent No.: US 6,669,876 B2
(45) Date of Patent: Dec. 30, 2003

(54) METHOD OF PREPARING SMOOTH, WATERTIGHT CONCRETE SURFACES ON CONCRETE POOLS

(76) Inventor: Bruce Torrance, 641 Ibis Dr., Delray Beach, FL (US) 33444

( * ) Notice: Subject to any disclaimer, the term of this patent is extended or adjusted under 35 U.S.C. 154(b) by 283 days.

(21) Appl. No.: 09/726,429

(22) Filed: Nov. 30, 2000

(65) Prior Publication Data

US 2002/0063352 A1 May 30, 2002

(51) Int. Cl.[7] ..... E04H 4/02

(52) U.S. Cl. ..... 264/34; 264/74; 264/139; 264/162; 264/245; 264/256; 52/741.41; 52/741.12; 405/268

(58) Field of Search ..... 264/34, 162, 74, 264/139, 256, 245; 52/741.41, 741.12; 405/268

(56) References Cited

U.S. PATENT DOCUMENTS

| | | | | |
|---|---|---|---|---|
| RE25,199 E | * | 7/1962 | Brownell, Jr. | 241/198.1 |
| 3,832,814 A | * | 9/1974 | Teschner | 249/DIG. 3 |
| 3,870,553 A | | 3/1975 | Hussey | 117/123 A |
| 4,141,737 A | * | 2/1979 | Moon et al. | 106/12 |
| 4,281,496 A | | 8/1981 | Danielsson | 52/612 |
| 4,948,296 A | * | 8/1990 | Salter | 264/256 |
| 4,977,730 A | | 12/1990 | Pardo | 52/602 |
| 4,981,626 A | | 1/1991 | Uchizaki | 264/23 |
| 5,441,677 A | | 8/1995 | Phillips, Sr. | 264/31 |
| 5,643,509 A | * | 7/1997 | Ytterberg et al. | 264/31 |
| 5,709,824 A | | 1/1998 | Ytterberg et al. | 264/34 |
| 5,794,401 A | * | 8/1998 | Shaw et al. | 427/202 |

FOREIGN PATENT DOCUMENTS

| | | | | |
|---|---|---|---|---|
| EP | 0038651 A1 | * | 10/1981 | C04B/41/32 |

* cited by examiner

*Primary Examiner*—Michael Colaianni
*Assistant Examiner*—Michael I. Poe
(74) *Attorney, Agent, or Firm*—Malin, Haley & DiMaggio, P.A.

(57) ABSTRACT

A method of preparing a smooth watertight concrete in-ground pool surface that eliminates the use of a plaster outer surface layer that includes allowing the concrete pool body to cure for at least thirty days at which time a grinder is used to grind the surface to a smoothness and depth that is watertight and that exposes aggregates within the pool surface resulting in an aesthetically desirable permanently finished pool surface.

8 Claims, 1 Drawing Sheet

METHOD OF PREPARING SMOOTH, WATERTIGHT CONCRETE SURFACES ON CONCRETE POOLS

BACKGROUND OF THE INVENTION

1. Field of the Invention

This invention relates to a method of forming concrete surfaces, and specifically to a method for providing a smooth, permanent watertight concrete pool surface without the need to laminate the cured concrete slab, thereby reducing the time, labor, cost and defects associated with laminating in-ground concrete pool surfaces.

2. Description of the Prior Art

Methods of creating and laminating concrete floor surfaces are known in the art. U.S. Pat. No. 4,281,496 issued to Danielsson, discloses a method of forming concrete floors for high-rise buildings wherein wet concrete mix is deposited and screeded to form concrete having a uniform thickness. The surface of the concrete is then floated to produce a generally flat surface. The surface of the concrete is treated by means of a power grinder, before the concrete has completely cured, to produce a flat, sanded surface.

The method described in Danielsson is specifically for cement floors in buildings and the resulting concrete surface is a rough, "sanded" surface; a requirement for building floors, which require traction for liability purposes. However, a rough, sanded concrete finish is impractical for pool floor surfaces, which are preferably smooth, glossy, and watertight, and are the result of the method described in Applicant's invention. Applicant's invention is further distinguished from Danielsson since it allows the concrete to fully cure prior to grinding the concrete surface.

U.S. Pat. No. 5,441,677 issued to Phillips, Sr., describes a method of fabricating a high gloss concrete floor. A finished floor surface layer is created by applying a dry shake dressing material containing quartz crystals and a coloring agent to the surface of a slab, floating the surface and waiting for the surface to cure. Curing sealer is applied, the sealer removed, and the upper surface is polished and sanded.

However, the invention in Phillips includes the step of applying a dry shake. This step actually applies an additional layer containing aggregates, to the concrete surface. Applicant's invention on the other hand, eliminates this step by grinding the original cement surface to expose its aggregates, without the need to apply a second aggregate-based coating.

U.S. Pat. No. 5,709,824 issued to Ytterberg et al. describes a method for forming a roller compacted concrete industrial floor slab including the steps of applying a no-slump concrete to a slab, finishing the slab by applying a finish surface mixture of cement-coated grit, and troweling the slab surface to obtain a smooth, burnished surface finish. Ytterberg describes a process requiring that an additional coat, including aggregates, be applied to the concrete surface. The method used by Ytterberg includes the step of troweling the surface after the additional coat is applied. Applicant's invention does not include this additional step of applying a second coating. The grinding process utilized by Applicant exposes the aggregates already present in the original concrete mixture.

Typically, in order to create a smooth concrete surface, for example, a pool surface, a cement mix is prepared and poured into an appropriately sized hole or ditch. After the concrete is cured and finished, a second coating usually comprised of plaster, is applied to the cured surface. The plaster coating is usually applied with use of a gun, or is hand-troweled onto the cured concrete surface.

This process of applying a second coating or laminate smoothes out the surface of the concrete and is usually mandatory for pool surfaces, since without it, walking on the cement surface would cause injury due to the rough, often uneven surface texture.

However, applying an additional coating is time-intensive, usually a three-hour process and costly. Further, the laminate coatings tend to dissolve and deteriorate after time due either to inherent imperfections in the laminate or to incorrect application. Deterioration of the laminate is akin to paint peeling off of a wall. The result is a waste of money, time and labor.

Accordingly, what is needed is a method to overcome the afore-mentioned problems in the art by eliminating the step of applying a second plaster-like finish or coating to the concrete surface, by grinding the surface of the concrete after curing. After grinding, aggregates, which already present in the concrete are exposed, and a smooth finish can be obtained without the need for an additional coating of plaster laminate.

It is, therefore, to the effective resolution of the afore-mentioned problems and shortcomings of the prior art that the present invention is directed.

SUMMARY OF THE INVENTION

The present invention is a method for preparing concrete surfaces and in particular, in-ground pool surfaces, by grinding the cured concrete surface to expose aggregates inherent in the concrete mixture thereby eliminating the step of applying a separate, additional aggregate coating to the concrete surface.

Specifically, the present invention comprises the steps of preparing a pool site which is to receive a predetermined amount of concrete mix. The concrete mix is prepared and applied to the site to form a concrete structure, the structure having an upper surface, a bottom surface and a predetermined thickness. The upper surface of the structure becomes the upward facing pool surface. A finish is applied to the concrete mix to produce a finished concrete surface. The concrete is allowed to fully cure, usually for a minimum of thirty (30) days. Plumbing fixtures are then inspected and grout is applied to the cured concrete to seal in the moisture and to assure watertightness of the plumbing fixtures.

In an alternate embodiment, a curing membrane is applied to the concrete surface to hold the moisture within the concrete. Finally, the cured concrete surface is subjected to grinding using a grinding tool such as a water-driven rotary tool, to expose the aggregates within the concrete. The result is a smooth, watertight pool surface, which eliminates the need for additional coatings and reveals the aggregates within the concrete, thereby allowing the pool designer to create a multitude of possible aggregate-based design patterns on the pool surface by allowing for different colored aggregates to be blended in the mixture and exposed subsequent to grinding.

It is an object of this invention to provide a method of preparing a smooth, glossy, watertight concrete surface without the need for a separate application of laminate.

It is another object of this invention to reduce time, cost and labor by providing a method of preparing in-ground pool surfaces that exposes the aggregates within the concrete mix thereby eliminating the step of applying an additional finishing coat containing aggregates.

It is yet another object of the present invention to provide a cost-effective method for allowing swimming pool designers to create a variety of swimming pool surface colors and designs by incorporating different types and amounts of aggregate within the original cement mixture.

In accordance with these and other objects which will become apparent hereinafter, the instant invention will now be described with particular reference to the accompanying drawings.

DESCRIPTION OF THE PREFERRED EMBODIMENTS

Figure 1:
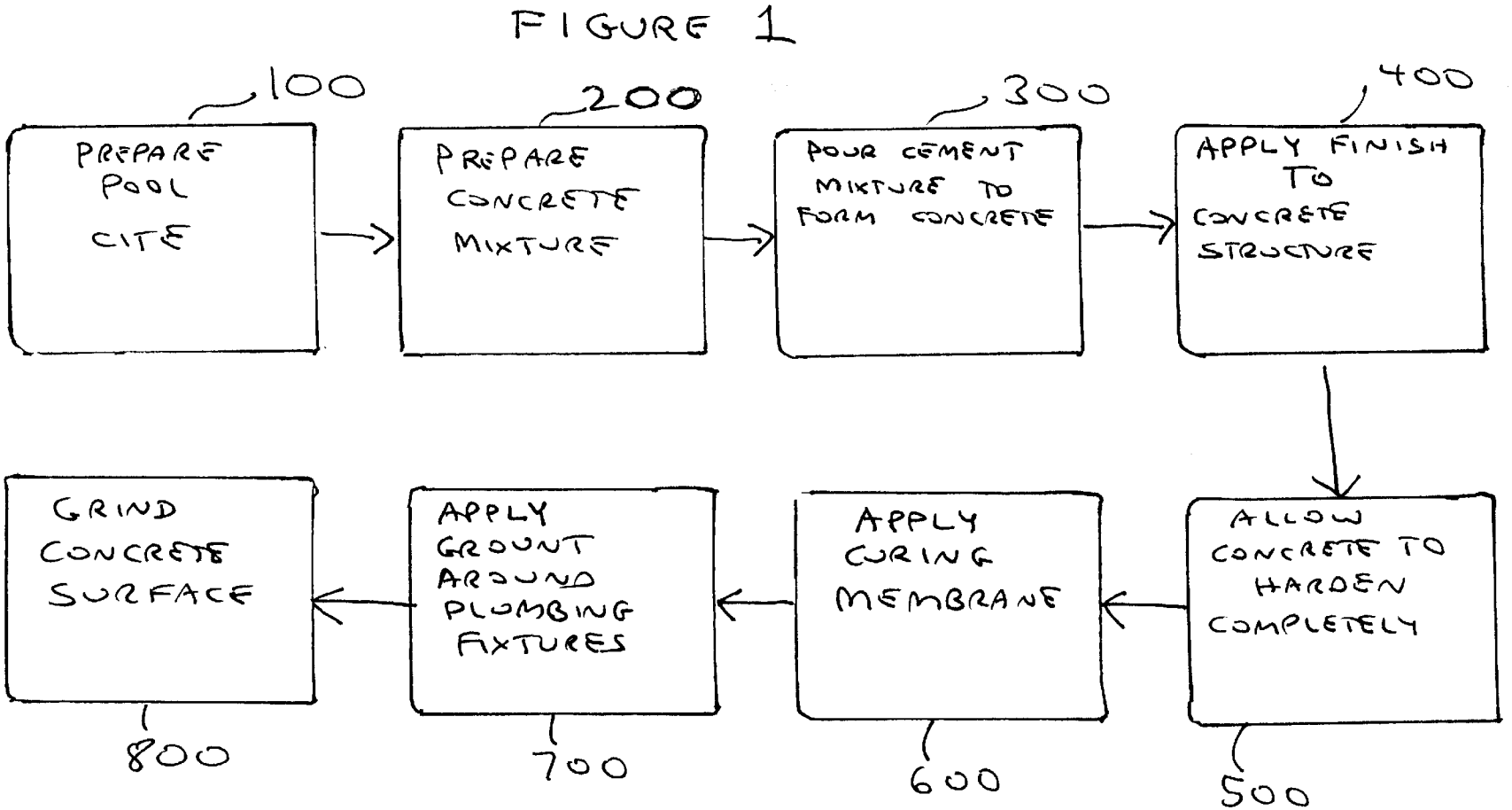
FIG. 1 shows the steps associated with carrying out the preferred embodiment of the present invention.

Turning now to the drawings, FIG. 1 is a block diagram showing the steps utilized by the present invention to prepare a smooth, watertight concrete surface, having a glossy finish, desirable in in-ground pool surfaces.

Although the present invention can be utilized for the preparation of virtually any concrete surface where it is desirous to achieve a smooth, watertight surface, the foregoing description will describe a method of forming an in-ground swimming pool surface.

Once a pool site has been selected via step 100 and a hole has been dug and prepared, an appropriate amount of concrete mix is prepared, step 200, and poured into the pool site hole. Preferably, the concrete mixture used is Silica Fume Concrete, which is comprised of 700–1100 pounds per cubic yard of washed concrete sand; 1800–2200 pounds per cubic yard of coarse aggregate; 500–750 pounds per cubic yard of cementitious; 90–125 pounds per cubic yard of silica fume; 150–340 pounds of water; and water reducer @ 2–10 oz./cwt cement. The cement mix may, however, include or be comprised of other materials, commonly used in the industry.

Once the concrete mix is poured, it forms a structure having an upper, exposed surface, a bottom surface and a pre-determined thickness, via step 300. The upper surface will ultimately form the in-ground swimming pool surface.

A finish is then applied to the upper surface of the cement slab, at step 400. Concrete surfaces that are visible, such as pool surfaces, require finishing. Finishing is required in slab construction in order to cut off excess concrete to bring the top surface of the slab to proper grade.

Although troweling is the preferred finishing method, various types of finishing processes are acceptable for use in the present invention. Screeding is one type of finishing process that can be used with the method of the present invention. This process usually involves a straight edge moving across the concrete with a sawing motion and slowly advanced foreword a short distance with each movement.

Bullfloating is another finishing process that can be used. Here, a long-handled straight edge is dragged across the concrete surface. Joining is required to eliminate cracks.

After the concrete has been placed and the structure formed, the moisture content within the concrete should be maximized by misting the surface with water. The concrete structure should not be subjected to freezing, and the desirable temperature range is generally maintained between 50° F. and 75° F. This maintaining process is called curing. Curing maintains the durability, strength, resistance to freezing and thawing, and water-tightness of the hardened concrete. The concrete should then be given sufficient time to harden, usually a minimum of thirty days, shown as step 500.

Plumbing fixtures such as pipes and drains are part of the pre-concrete site preparation. Concrete is then poured over the plumbing fixtures.

In an alternate embodimen, a curing membrane, such as MASTER BUILDERS MASTERKURE® curing membrane, or other similar product can be applied to the concrete mix in order to further retain moisture within the concrete mix, as shown in step 600.

After the concrete is allowed to completely harden, plumbing fixtures are installed and grouting is applied to the concrete to seal in any moisture within the concrete and assure watertightness of the plumbing fixtures, shown at step 700. The grout is then allowed to cure for approximately 12 hours.

According to the method of the present invention, after the concrete has been allowed to cure completely, a grinding tool, such as the Water-Driven Rotary Tool described in U.S. Pat. No. 5,620,364, or the Improved Direct Drive Water-Driven Rotary Tool described in U.S. patent application Ser. No. 09/345,275, both of which are incorporated herein by reference, is used to grind the entire concrete surface of the pool, via step 800. As opposed to other concrete surface preparation methods, the method employed by the present invention grinds the concrete surface, instead of merely leveling or troweling the surface. Further, no additional laminates or plaster coatings are applied to the concrete surface.

By grinding the concrete surface, the aggregates within the concrete are revealed, thereby allowing the pool designers to create a multitude of design patterns on the pool surface by incorporating different mixtures of aggregates into the concrete mix.

Although troweling has the effect of producing an even, concrete surface, it does not result in the exposure of the aggregates within the concrete. A second coating must be applied to either add aggregates or to further smooth out the concrete surface. As a result of Applicant's invention, this second coating application can be eliminated, resulting in a significant savings of cost, labor and time.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A method for preparing a smooth, watertight concrete surface on a concrete pool body comprising the steps of:

preparing a pool site which is to receive a predetermined amount of concrete mix;

preparing said concrete mix;

applying said concrete mix to said pool site to form a concrete pool body, said concrete pool body having an upper surface, a bottom surface and a predetermined thickness suitable for a pool;

applying an initial finish to said upper surface of said concrete pool body while said concrete cool body is trowelable to produce an initial finished concrete surface;

allowing said finished concrete surface to adequately cure for a predetermined amount of time of at least seven days; and grinding said cured upper surface of said concrete pool body sufficiently to create said smooth, watertight concrete surface and to expose aggregates within the concrete surface wherein said smooth, watertight concrete surface is created without the additional steps of applying a second coating or laminate to said cured upper surface.

2. The method of claim 1 wherein said grinding is performed with a water-driven rotary tool.

3. The method of claim 1 wherein said cement mix is comprised of Silica Fume Concrete.

4. The method of claim 1 further comprising the step of applying a curing membrane to said finished concrete surface to hold moisture within said finished concrete surface.

5. The method of preparing a concrete swimming pool surface having a smooth, watertight finish, said method comprising the steps of:

preparing the swimming pool site which is to receive a predetermined amount of concrete mix;

preparing said concrete mix;

applying said concrete mix to said site to form a concrete pool body structure, said concrete pool body structure having an upper surface, a bottom surface and a predetermined thickness;

applying an initial leveling finish to said upper surface of said concrete pool body structure before curing to initially produce a rough finished concrete pool surface;

allowing said rough finished concrete pool surface to adequately cure for at least thirty days; and grinding said cured rough finished concrete pool surface of said concrete pool body structure sufficiently to create said smooth, watertight finish and to sufficiently expose aggregates within said concrete swimming pool surface wherein said smooth, watertight finish is created without the additional step of applying a second coating or laminate to said cured rough finished concrete pool surface.

6. The method of claim 5 wherein said grinding is accomplished with a water-driven rotary tool.

7. The method of claim 5 wherein said cement mix is comprised of Silica Fume Concrete.

8. The method of claim 5 further comprising the step of applying a curing membrane to said rough finished concrete pool surface to hole moisture within said rough finished concrete pool surface.

* * * * *